US006159066A

United States Patent [19]

Amatsu et al.

[11] Patent Number: 6,159,066

[45] Date of Patent: Dec. 12, 2000

[54] GLASS MATERIAL USED IN, AND FABRICATION METHOD OF, A PLASMA DISPLAY PANEL

[75] Inventors: Masashi Amatsu; Shinji Kanagu; Masaaki Sasaka, all of Miyazaki; Noriyuki Awaji, Kakogawa; Kazumi Ebihara, Miyazaki, all of Japan

[73] Assignee: Fujitsu Limited, Kawasaki, Japan

[21] Appl. No.: 09/288,696

[22] Filed: Apr. 9, 1999

Related U.S. Application Data

[62] Division of application No. 08/750,796, Dec. 18, 1996.

[51] Int. Cl.[7] ..... H01J 9/00; H01J 9/24; H01J 9/26; H01J 9/32

[52] U.S. Cl. ..... 445/24; 445/25

[58] Field of Search ..... 445/24, 25

[56] References Cited

U.S. PATENT DOCUMENTS

| | | | |
|---|---|---|---|
| 4,451,761 | 5/1984 | Kay | 313/586 |
| 4,578,619 | 3/1986 | Braude | 313/586 |
| 4,692,662 | 9/1987 | Wada et al. | 313/493 |
| 4,741,963 | 5/1988 | Wada et al. | 428/428 |
| 5,264,758 | 11/1993 | Iijima et al. | 313/584 |
| 5,703,437 | 12/1997 | Komaki | 313/587 |
| 5,838,106 | 11/1998 | Funada | 313/587 |
| 5,846,110 | 12/1998 | Kanagu et al. | 445/25 |

FOREIGN PATENT DOCUMENTS 0 131 389 1/1985 European Pat. Off. .

OTHER PUBLICATIONS

Patent Abstracts of Japan, vol. 096, No. 007, Jul. 31, 1996, (Pioneer Electron Corp.), Mar. 22, 1996.

*Primary Examiner*—Kenneth J. Ramsey
*Assistant Examiner*—Michael J. Smith
*Attorney, Agent, or Firm*—Staas & Halsey LLP

[57] ABSTRACT

It is an object of the present invention to prevent deterioration of a transparent electrically-conductive film which forms display electrodes, so as to enhance the reliability of display electrodes. In an AC type plasma display panel including a plurality of display electrodes X & Y formed of a transparent electrically-conductive film or a multiple layer of a transparent electrically-conductive film plus a metal film a width of which is narrower therethan, and a dielectric layer to cover the display electrodes from the discharge space, the dielectric layer is formed by the use of a ZnO-containing glass material containing substantially none of lead. Moreover, the display electrodes are protected by coating the dielectric layer so far as the ends of display electrodes; and the coating is removed afterwards by etching, etc.

35 Claims, 4 Drawing Sheets

GLASS MATERIAL USED IN, AND FABRICATION METHOD OF, A PLASMA DISPLAY PANEL

This application is a divisional of application Ser. No. 08/750,796, filed Dec. 18, 1996, now allowed.

FIELD OF THE INVENTION

The present invention relates to an AC type surface-discharge plasma display panel, referred to hereinafter as a PDP, and its driving method.

BACKGROUND TECHNOLOGY

PDPs are self-luminescent type of display devices advantageous in the display brightness, and have been attracting attention as a display device for replacing CRTs, owing to their potentiality of large screen size and their high-speed displaying capability. Particularly, surface-discharge type PDPs suitable for color displays employing fluorescent materials have been rapidly increasing their application areas in the field of television picture including the high definition television.

FIG. 1 shows an exploded perspective view of a general surface-discharge type PDP, in which is shown a basic structure of a part which corresponds to a single picture element EG. The PDP1 shown in FIG. 1 is of a three-electrode structure called a reflection type in the classification of fluorescent materials arrangement, employing a pair of glass substrates 11 and 21; pairs of display electrodes X & Y provided thereon extending in the lateral direction in parallel adjacently to each other; a dielectric layer 17 for an AC drive which utilizes wall charges for a discharge; a protection film 18 formed of magnesium oxide (MgO); address electrodes A orthogonal to display electrodes X & Y; separator walls 29 which are like lines in parallel to address electrodes A when looked down; and fluorescent material layers 28 to display primary colors, red (R), green (G) and blue (B), respectively.

Separator walls 29 divide an internal discharge space 20 into unit lighting-areas EU in the extending direction of display electrodes X & Y, and define the gap dimension. Fluorescent material layers 28 are provided between each separator wall on a glass substrate 21 opposite from display electrodes X & Y in order to avoid ion bombardment of the surface discharge, and emits a light by being excited by an ultra violet light generated in the surface discharge. A light emitted at the surface plane (a surface which faces the discharge space) penetrates dielectric layer 17 and glass substrate 11, etc. so as to radiate outwardly from display surface 4.

Display electrodes X & Y being arranged on a display surface H which opposes fluorescent material layers 28 are formed of a wide and transparent electrode 41 and a narrow metal film (a bus electrode) 42 for supplementing the electrical conductivity, in order to perform the surface discharge in a wide area and to minimize the light shielding. Transparent electrode 41 is formed of metal oxide, such as ITO (indium oxide) and NESA (tin oxide). A typical example of this kind of AC type surface discharge PDP was disclosed in European Patent Application No. 0 554 172A1.

For thus constituted PDP, its smoother surface plane is desirable in securing a uniform discharge characteristics and the transparency.

Accordingly, dielectric layer 17 is generally formed of a single glass layer such that a low-melting temperature lead-glass (containing about 75% of PbO) having a melting temperature of, for example about 470° C., is fired at a temperature 600° C. adequately higher than its softening temperature. The high temperature firing at the temperature adequately higher than its softening temperature allows the glass material to flow during the firing so as to accomplish a glass layer having a flat surface.

In driving PDPs, the equality of the electric potential status between display electrodes X & Y is deteriorated when the pulse widths of the driving pulses, applied to the display electrodes X & Y of each pair, are subtly imbalanced or when such a sequence is constantly employed that the number of the pulses applied to one of display electrodes is more than those to the other one. That is, a DC voltage of, for example, about 200 V of the same polarity comes to be applied thereto for a considerable period. On the other hand, the gap between display electrodes X & Y is as small as 100 $\mu$m. And, the dielectric layer 17 to insulate them contains PbO as described above. It is estimated that the surface of dielectric layer 17 upon whose surface a discharge takes place becomes a considerably high temperature. Really, the glass surface reaches 70° C. Moreover, indium and tin included in the transparent electrodes are chemically unstable, and also the copper of the metal electrodes are materials which easily penetrates into dielectric layer 17 so as to cause electro-migration. Combination of the electrode material, insulating material, the applied high electric field and the high temperature satisfies the condition to accelerate the electro-migration.

A long term operation, under such a condition of the prior art structure causes the electro-migration of display electrodes X & Y to progress such that a tree-like spike is grown in dielectric layer 17, from transparent electrode film 41 of one of the display electrodes to transparent electrode film 41 of the other one of the display electrodes. Therefore, there was a problem in that the insulation resistance was locally decreased, whereby a unit lighting area EU that should not light erroneously lights. It is impossible to completely remove the imbalance of the applied voltages which is the cause of the electro-migration.

DISCLOSURE OF THE INVENTION

The present invention is in consideration of such problems, and aims at a prevention of deterioration of the electrically conductive films, constituting display electrodes X & Y, so as to enhance the reliability of the display.

In accomplishing the present invention the present inventors have searched for dielectric materials suitable to cover the above-described electrically conductive films. Consequently, it was found that an employment of a glass material containing ZnO allows a great reduction of the deterioration of electrically conductive films caused from the electro-migration.

The PDP according to the present invention is an AC-type plasma display panel comprising: a plurality of display electrodes formed of a transparent electrically conductive film or a multiple-layer of a transparent electrically conductive film plus a metal film narrower than the transparent electrically conductive film at least upon one of the substrates; and a dielectric layer covering the above-described display electrodes from a discharge space, wherein the above-described dielectric layer is formed of a ZnO-containing glass material containing substantially no lead.

Moreover, after the dielectric layer employing the ZnO-containing glass material is coated over the entirety of the whole display electrodes and a sealing process is completed, the dielectric layer that covers the ends of the display electrodes are removed.

DESCRIPTION OF THE NOTATIONS

1 PDP (Plasma Display Panel)
10 electrode substrate;
11 first glass substrate;
17 dielectric layer;
17A lower layer;
17*a* electrode terminal protecting layer;
17B upper layer;
21 second glass substrate;
30 discharge space;
41 transparent electrically conductive film;
41*a* end (end of display electrode);
42 metal film;
171 glass layer containing ZnO; and
X & Y display electrodes.

DETAILED DESCRIPTION OF THE PREFERRED EMBODIMENTS

Figure 1:
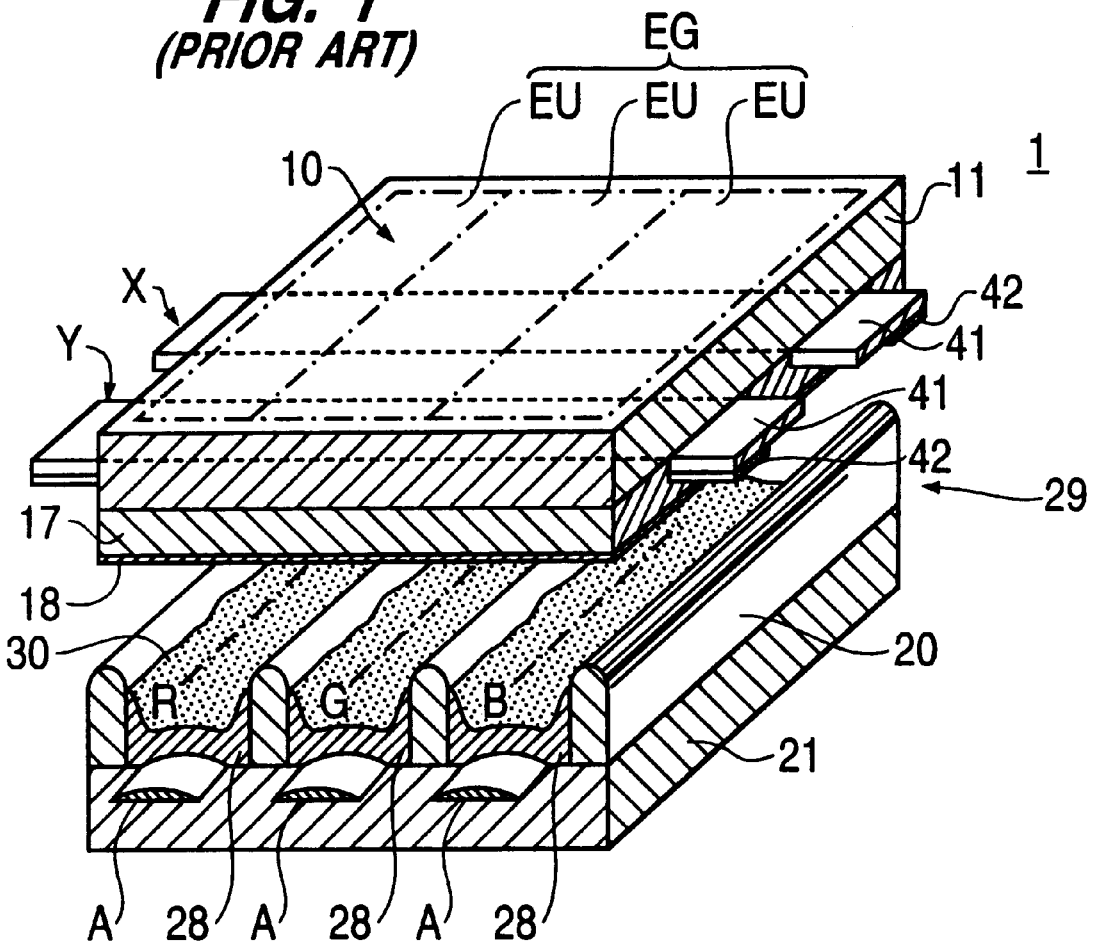
FIG. 1 (PRIOR ART)
FIG. 1 is a decomposition (i.e., exploded) perspective view of a general surface-discharge type PDP.
Figure 2:
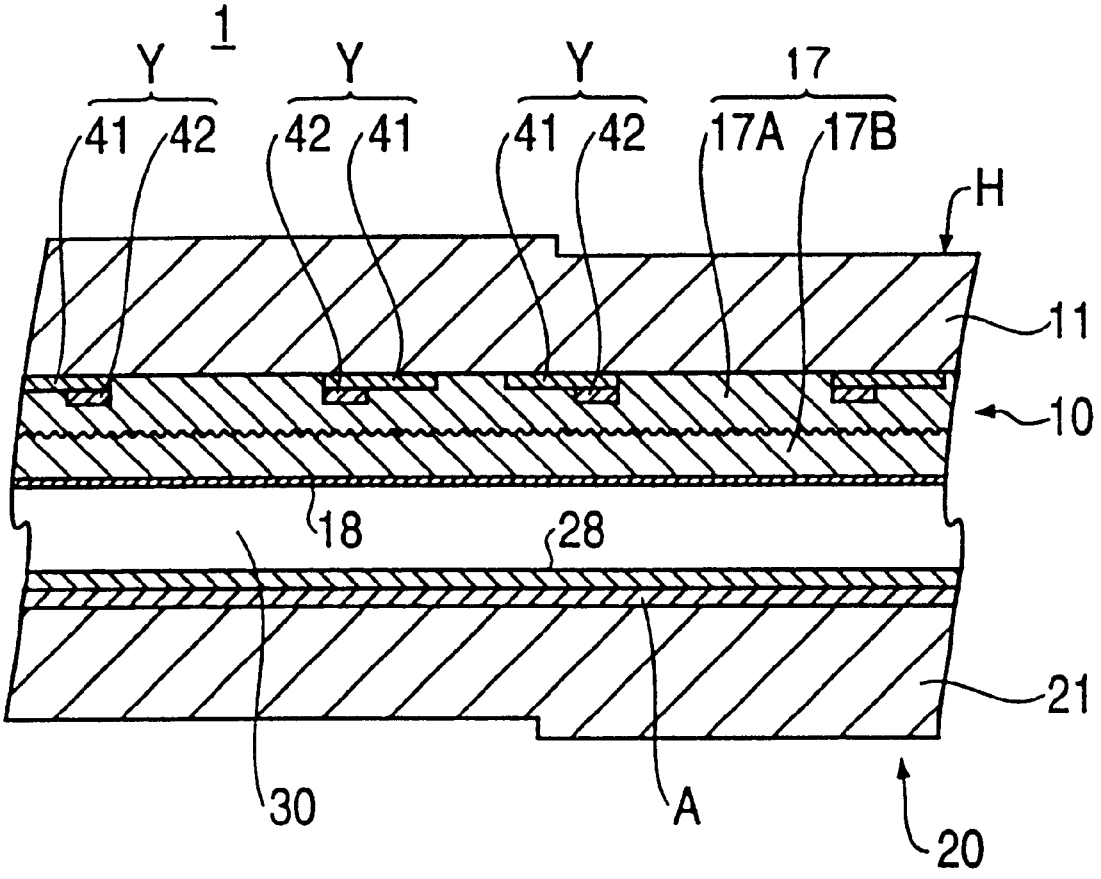
FIG. 2 is a cross-sectional view illustrating a main portion of the structure of a PDP related to the present invention.

Structures of the PDPs according to the present invention are not essentially different from the prior art PDP shown in FIG. 1, except for the below-described dielectric materials and the fabrication conditions related thereto. These are hereinafter described with reference to a cross-sectional view shown in FIG. 2.

PDP 1 according to the present invention is a surface-discharge type PDP of a three-electrode structure, where a pair of display electrodes X & Y and address electrode A correspond to a unit lighting area of the matrix display.

Display electrodes X & Y are provided on a first glass substrate 11 placed at a front side, and are insulated from a discharge space 30 by an insulating film 17 for an AC drive. Thickness of insulating film 17 is about 20 to 30 $\mu$m. Upon surface of insulating film 17 is provided an MgO film 18 of about several thousand Å thick thickness as a protection film.

Display electrodes X & Y are formed of a wide belt-like transparent electrically conductive film 41 and a narrow bus metal film 42 stacked on its outer edge in order to supplement the electrical conductivity. Transparent electrically conductive film 41 is formed of an ITO film (indium oxide film) of about several thousands Å–1 $\mu$m thickness; and bus metal film 42 is formed of a thin film of a three layer structure of Cr/Cu/Cr, for example.

Upon a second glass substrate 21 to be placed at the back side are arranged address electrodes A for selectively lighting the unit lighting area so as to cross display electrodes X & Y. Fluorescent material 28 emitting a predetermined color, that is the three primary colors RGB, is provided to cover the inner surface of the back panel including the upper surface of address electrodes A.

Dielectric layer 17 of the present invention is formed of a lower layer 17A contacting transparent electrically conductive film 41 and bus metal film 42, and an upper layer 17B stacked on lower layer 17A. Lower layer 17A is formed of a glass material containing ZnO and having a softening temperature 550–600° C.; and upper layer 17B is formed of a glass material having a softening temperature 450–500° C., which is lower than that of lower layer 17A, including PbO. The thicknesses of lower layer 17A and upper layer 17B are of the same order. The softening temperature is defined as a temperature at which the viscosity of the glass material becomes 4.5×106.5 poise.

Figure 3A:
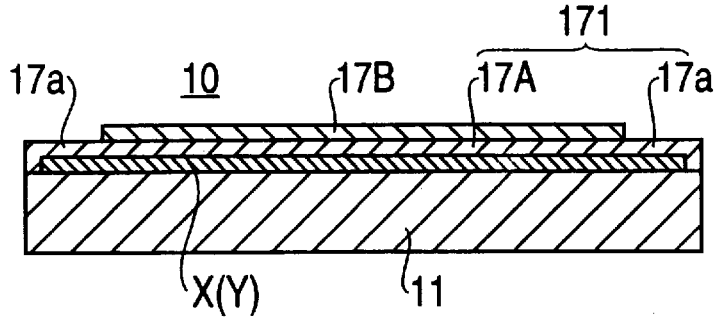
FIG. 3 schematically illustrates the PDP at successive manufacturing steps.
Figure 3B:
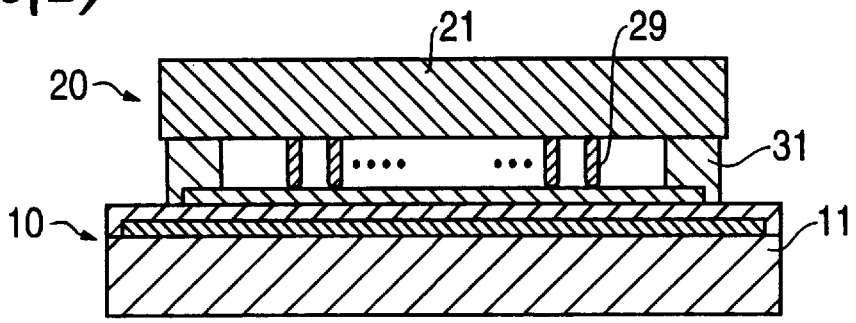
Figure 3C:
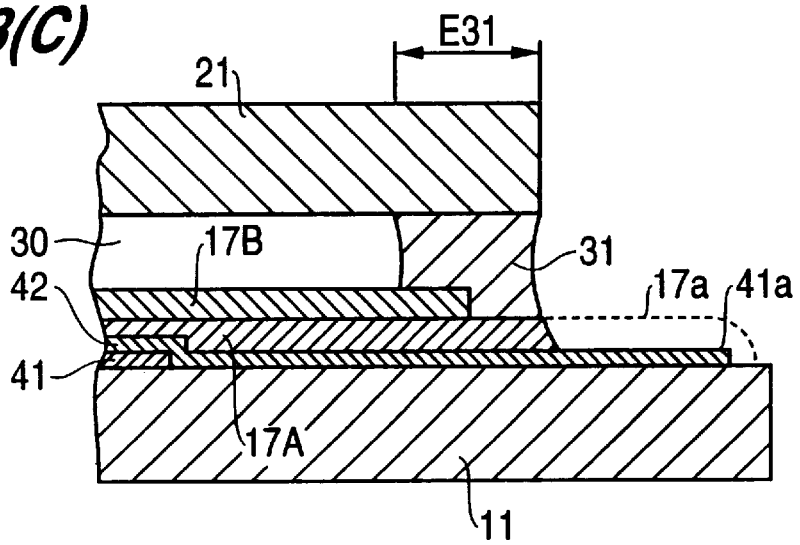

Hereinafter is described a fabrication method of a PDP 1 of the present invention, mainly about the formation steps of dielectric layer 17. FIGS. 3(A) to 3(C) schematically illustrate manufacturing steps of the PDP 1. At first is described the outline of the steps. PDP 1 is fabricated in accordance with sequential steps such that each glass substrate 11 & 12 is provided with predetermined structural elements, respectively, so as to make a front 10 and a back half panel 20; next, the front and back half panels 10 & 20 are stacked with each other so as to be sealed; and next, internal gas is exhausted; and a discharge gas is filled thereinto.

Hereinafter described is a fabrication method of first glass substrate 11. First glass substrate 11 is an about 3 mm thick soda-lime glass plate coated with silicon dioxide film ($SiO_2$) on one of its surfaces. Upon the $SiO_2$-coated surface are formed display electrodes X & Y by sequentially forming transparent electrically conductive film 41 and metal bus electrode by film-formation using a vapor deposition or sputtering method, and patterning with a lithography method. Next, upon the surface of first glass substrate 11 is uniformly coated, so as to cover the entire length of the display electrodes X & Y by means of a screen printing method, a glass paste having mainly a glass material containing ZnO but substantially no PbO, for example, the glass material (softening temperature 585° C.) having the contents shown in FIG. 1 or the glass material (softening temperature 580° C.) having the contents shown in FIG. 2.

TABLE 1

| CONTENTS OF LOWER LAYER GLASS MATERIAL (CONTAINING ZnO) | | |
|---|---|---|
| ZnO | 30–40 | Wt % |
| $B_2O_3$ | 10–20 | Wt % |
| $SiO_2$ | –5 | Wt % |
| $Bi_2O_3$ | 20–30 | Wt % |

Softening Temp.: 585° C.

TABLE 2

| CONTENTS OF LOWER LAYER GLASS MATERIAL (CONTAINING ZnO) | | |
|---|---|---|
| ZnO | 30–40 | Wt % |
| $B_2O_3$ | 15–25 | Wt % |
| $SiO_2$ | –8 | Wt % |
| $Bi_2O_3$ | 20–30 | Wt % |
| CaO | 7–17 | Wt % |
| $Na_2O$ | 0 | Wt % |

Softening Temp.: 580° C.

Next, the dried paste layer is fired at a temperature, for example 550–590° C., near its softening temperature so as to form lower layer 17A and an electrode terminal protecting layer 17*a* while foaming is prevented therein. In order to prevent deformation of glass substrate 11, it is preferable that the firing temperature is lower than 590° C. as described above. Accordingly, the softening temperature of the upper layer 17B is set adequately lower than 590° C.

The portion, for indirectly facing the discharge space, of thus fired glass layer 171 containing ZnO is the lower layer 17A; and a portion for covering the ends of the display electrodes is called the electrode terminal protecting layer 17*a*. Electrode terminal protecting layer 17*a* also plays a role to protect oxidization of display electrodes X & Y caused from the reaction with moisture during the subsequent heat treatments.

In the case where the firing temperature of lower layer 17A is lower than in the vicinity of its softening temperature, even if a chemical reaction is generated to accompany a foaming caused from the contact of the glass material to the copper in bus metal film 42, no bubble so large as to cause insulation breakdown is generated because the foam does not grow. However, if the firing temperature of lower layer 17A is low, the surface plane (upper surface) becomes uneven (a rugged surface having surface roughness 5–6 $\mu$m) reflecting the glass grain size. The rugged surface deteriorates the transparency resulting from the scattering of the light.

Therefore, upper layer 17B is formed upon lower layer 17A in order to flatten the dielectric layer 17. As the upper layer 17B there is coated a paste material having its softening temperature lower than the material of lower layer 17A, i.e. a paste whose main component is a glass material containing PbO (softening temperature 475° C.), for example, of the component shown in TABLE 3. At this time the area to be coated excludes the above of the ends (to become the terminals) of display electrodes X & Y. This is from a consideration to facilitate afterwards the fabrication steps to expose the ends of display electrodes X & Y. These steps will be described later again.

TABLE 3

CONTENTS OF UPPER LAYER GLASS MATERIAL (CONTAINING PbO)

| | | |
|---|---|---|
| PbO | 70–75 | Wt % |
| $B_2O_3$ | –20 | Wt % |
| $SiO_2$ | 10–20 | Wt % |

Softening Temp.: 475° C.

Next, the dried paste layer is fired at a temperature higher than its softening temperature but lower than the firing temperature of lower layer 17A, (for example, 530° C.) so as to form upper layer 17B [FIG. 3(A)]. Due to the firing temperature being higher than the softening temperature of upper layer 17B, the glass material of upper layer 17B flows during the firing operation so as to form a flat upper layer 17B whose surface roughness is about 1–2 $\mu$m (that is the dielectric layer 171 formed of the two layers 17A and 17B together).

Moreover, owing to the firing temperature of upper layer 17B being lower than the firing temperature of the lower layer 17A, the foaming in lower layer 17A can be prevented. Upon thus fabricated electrode substrate 10 is formed concurrently the layer 17*a* which serves as both a dielectric layer and an electrode terminal protecting layer, as described above; therefore, the simple layer structure allows excellent yield; moreover, the process to expose the electrode terminals is easy as will be described later, and is suitable in fabricating PDP 1.

Figure 4:
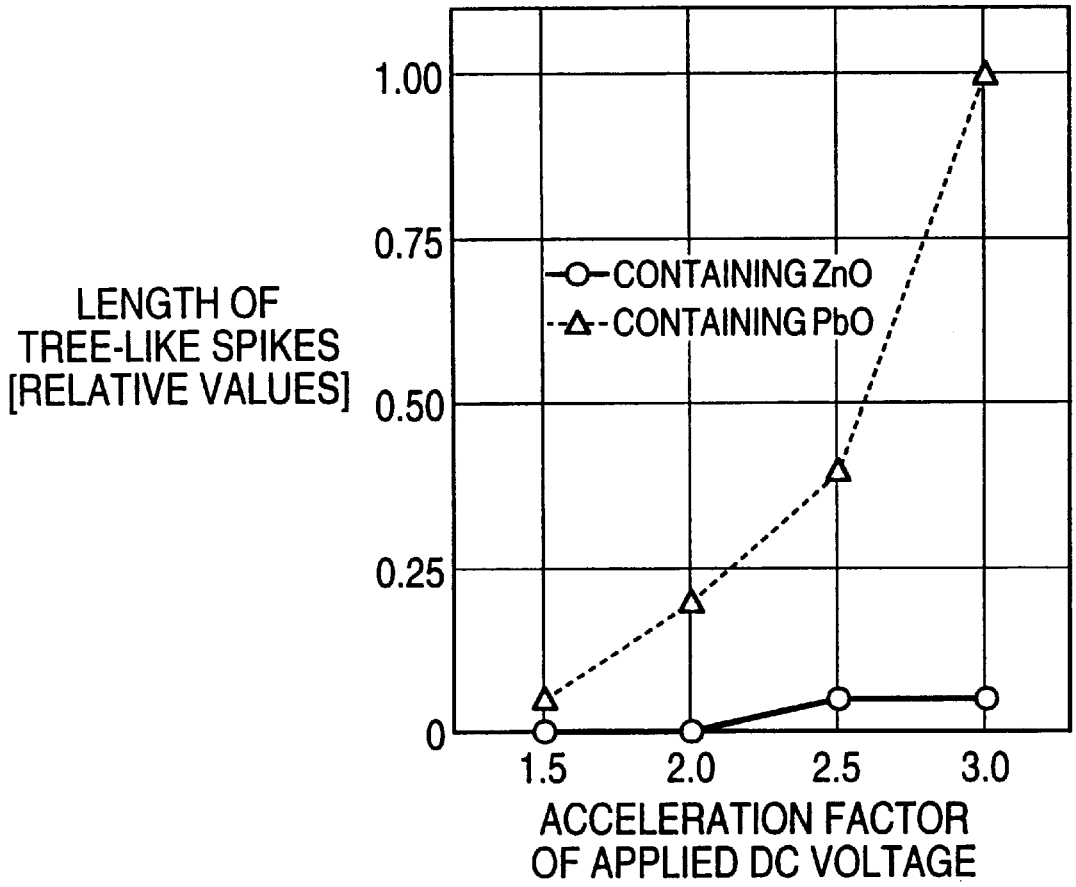
FIG. 4 is a graph showing the relation between deterioration of a transparent electrically conductive film formed of ITO and the dielectric materials.

For the glass material including ZnO, it is comparatively difficult to lower the softening temperature; therefore, the softening temperature is lowered by adding $Bi_2O_3$ thereto. The softening temperature can be lowered by adding alkaline metal oxides such as represented by $Na_2O$ as shown in FIG. 4. Softening temperature of the glass material having the contents shown in TABLE 4 is 550° C.

TABLE 4

CONTENTS OF LOWER LAYER GLASS MATERIAL (CONTAINING ZnO)

| | | |
|---|---|---|
| ZnO | 30–40 | Wt % |
| $B_2O_3$ | 15–25 | Wt % |
| $SiO_2$ | –11 | Wt % |
| $Bi_2O_3$ | 20–30 | Wt % |
| CaO | –4 | Wt % |
| $Na_2O$ | –5 | Wt % |

Softening Temp.: 550° C.

After lower layer 17A and upper layer 17B are sequentially formed so as to provide the combined, or composite, dielectric layer 17 as described above, a protection layer 18 is formed by electron beam sputtering, etc. of MgO, as is well-known, so as to complete the fabrication of the front glass substrate.

Next, a back electrode substrate 20, fabricated otherwise, and front electrode substrate 10 are stacked to face each other so that they are sealed together by fusing sealing-glass 31 which acts also as an adhesive [FIG. 3(B)], in practice, the sealing glass 31 is provided in a frame shape by means of screen printing on one or both of the electrode substrates before they are stacked; then, they are stacked and fuse-sealed. At this time, the fusing temperature is set at such a temperature that does not deform separator walls 29, for example about 450° C. During this fusing of sealing glass 21, electrode terminal protection layer 17*a*, protects the ends of display electrodes from the oxidation.

Next, electrode terminal protection layer 17*a*, exposed outside the panel, is removed by a chemical etching employing, for example, nitric acid so as to expose the ends 41*a* of display electrodes X & Y [FIG. 3(C)]. At this time, the ends of display electrodes X & Y, being formed of a single layer of metal film 42 only, are not etched by the nitric acid solution when exposed. If a discharging is to be performed during exhausting the inside of the panel, the etching of electrode terminal protection layer is performed before the exhausting step. After the PDP is completed, this exposed portion is connected via an isotropic electrically-conductive film and a flexible cable to an external driving circuit.

FIG. 4 is a graph presenting a relation between the deterioration of ITO film and the dielectric material. That is, there were prepared a sample in which display electrodes X & Y are covered with the glass material containing ZnO having the contents of TABLE 1, and another sample coated with the prior art glass material containing PbO having the contents of TABLE 5. Softening temperatures of both the samples were chosen almost equal. Lengths of tree-like spikes were measured by a microscopic observation, while accelerated lift tests were performed on these samples as applied with DC voltages of the driving pulses multiplied by an acceleration factor of the driving pulses, i.e. 100V× acceleration factor, for a predetermined period (for example, 100 hr), at an environmental temperature 90° C. The results are shown in FIG. 3. The lengths of the tree-like spikes are normalized by the length at three-times acceleration of the glass material containing PbO.

TABLE 5

| CONTENTS OF GLASS MATERIAL CONTAINING PbO | | |
|---|---|---|
| PbO | 60–65 | Wt % |
| $B_2O_3$ | 5–10 | Wt % |
| $SiO_2$ | 20–30 | Wt % |

Softening Temp.: 575° C.

As apparent from FIG. 4, when the dielectric material contacting the ITO film (transparent conductive film) is formed of a glass material containing ZnO, none of the tree-like spikes were observed at a 1.5–2.0 time acceleration test; on the other hand, at 2.5–3.0 time acceleration tests the tree-like spikes were observed, however, the lengths of the spikes were much shorter than the case where the glass containing PbO was employed.

In the case where display electrodes X & Y were formed of NESA ($SnO_2$) in place of ITO, similar results were obtained as well. That is, in the PDP having display electrodes, X & Y formed of NESA it also was confirmed that the glass material containing ZnO is suitable for the dielectric material.

In the above described preferred embodiment, owing to the employment of glass material having softening temperature lower than the softening temperature of lower layer 17A for the upper layer 17B, even if gas is generated in lower layer 17A during firing of upper layer 17B, the gas diffuses through upper layer to outside so that no gas is confined by upper layer 17B. Moreover, when a glass material whose softening speed is faster than the lower layer 17B the is employed for the material of upper layer 17B, upper layer 17A can be kept soft compared with lower layer 17B during firing of upper layer 17B; accordingly, the gas can be prevented in the same way from being confined by upper layer 17B.

In the above-described preferred embodiments, the material of each glass substrate 17A, & 17B; the ratio of the respective thickness; the firing condition temperature profile), etc. can be appropriately modified according to the glass substrate material; the coating material on the substrate surface; the material of transparent electrically conductive film 41 and the bus metal film material a uniform dielectric layer 17 having a flat upper surface can be accomplished.

Though in the above preferred embodiment there was typically referred to a case where a PbO-containing glass was employed for the upper layer, upper layer 17B also can be formed of a ZnO-containing glass.

Moreover, though in the above preferred embodiment there was typically referred to a dielectric layer 17 of double-layer structure, it is not necessary a double-layer structure. That is, it is possible for the dielectric layer 171 to be provided at a single-glass layer formed of a ZnO-containing glass. In this case, the materials and the condition are chosen by the balance of the disadvantages, such as the remaining of the foam in the glass material and the surface flatness, and the advantage that the process is simple. Selective employment of fine grain glass powder can contribute to improvement of the surface flatness.

Though in the above preferred embodiment there was typically referred to a case where the display electrode is formed of a transparent electrically conductive film and a metal film provided thereon it is needless to say that the present invention can be embodied in the case of the transparent electrically conductive film only having no metal film.

When the ZnO-containing glass is employed for the dielectric layer which contacts the transparent electrically conductive layer according to the present invention, the deterioration of the electrical resistance between display electrodes caused from electro-migration hardly takes place even during a long term operation of the PDP.

The dielectric layer of double layers, such that the upper layer having its softening temperature is lower than that of the lower layer, allows only the upper layer to flow fluidly in forming the dielectric layer, and the chemical reaction of the lower layer with the display electrodes is controlled; therefore, there can be accomplished a dielectric layer having no large bubble, a flat surface and good transparency.

Moreover, chemical etching of the material of the ZnO-containing glass is easy; therefore, it can be employed as a coating layer, i.e. electrode terminal protecting layer, to protect, i.e. protection from oxidization, the electrode ends which are to become external connection terminals of the display electrodes during the fabrication steps of the PDP. That is, the employment of the ZnO-containing glass allows concurrent formation of the dielectric layer and the electrode terminal protection layer, so as to reduce the number of the fabrication steps.

What is claimed is:

1. A method of fabricating a substrate to an AC type plasma display panel having a discharge space and wherein the substrate has a major surface on which electrically conductive display electrodes are formed, the method comprising:

forming a layer, of a first glass material containing ZnO and substantially no lead, on the major surface of the substrate so as to cover the display electrodes and firing the first glass material layer to form a first dielectric layer;

defining a first portion of the first dielectric layer covering first portions of the display electrodes corresponding to the discharge space and a second portion of the first dielectric layer covering second portions of the display electrodes, the second portions of the display electrodes being integral with and comprising terminal portions of respective first portions of the display electrode; and removing the second portion of the first dielectric layer to expose the second portions of the display electrodes.

2. The method fabricating a substrate of an AC type plasma display panel as recited in claim 1, wherein the first glass material further contains an alkaline metal oxide.

3. The method fabricating a substrate of an AC type plasma display panel as recited in claim 1, wherein the first glass material further contains bismuth oxide.

4. The method of fabricating a substrate of an AC type plasma display panel as recited in claim 1, wherein the first glass material further contains sodium oxide.

5. The method of fabricating a substrate of an AC type plasma display panel as recited in claim 1, further comprising:

forming a second dielectric layer, of a second glass material having a second softening temperature lower than a first softening temperature of the first dielectric layer, on the first portion of the first dielectric layer; and heating the second dielectric layer at a temperature lower than the first softening temperature of the first dielectric layer so as to cause the material of the second dielectric layer to flow and form a flat exposed surface.

6. A method of fabricating a plasma display panel having a discharge space, comprising the steps of:

forming a plurality of display electrodes extending in a first direction on a major surface of a first substrate;

forming a layer, of a first glass material containing ZnO and substantially no lead, on the major surface of the substrate so as to cover the display electrodes and firing the first glass material layer to form a first dielectric layer;

defining a first portion of the first dielectric layer covering first portions of the display electrodes corresponding to the discharge space and a second portion of the dielectric layer covering second portions of the display electrodes, the second portions of the display electrodes being integral with and comprising terminal portions of respective first portions of the display electrodes;

assembling a second substrate in opposed relationship with the display portion of the major surface of the first substrate and with the discharge space therebetween and bounded by a periphery of the second substrate;

forming a sealant joint between the first and second substrates along the periphery of the second substrate, bounding and sealing the discharge space and fixedly joining the first and second substrates; and removing the second portion of the first dielectric layer to expose the second portions of the display electrodes.

7. The method of fabricating a plasma display panel as recited in claim 6, wherein the first glass material further contains an alkaline metal oxide.

8. The method of fabricating a plasma display panel as recited in claim 6, wherein the first glass material further contains bismuth oxide.

9. The method of fabricating a plasma display panel as recited in claim 6, wherein the first glass material contains sodium oxide.

10. The method of fabricating a plasma display panel as recited in claim 6, further comprising, prior to the assembling step:

forming a second dielectric layer, of a second glass material having a second melting temperature lower than a first softening temperature of the first glass material, on the first portion of the first dielectric layer; and heating the second dielectric layer at a temperature lower than the softening temperature of the first dielectric layer so as to cause the material of the second dielectric layer to flow and form a flat exposed surface facing the discharge space.

11. A method of fabricating a plasma display panel having a discharge space, comprising the steps of:

forming a plurality of electrically conductive display electrodes on a major surface of a first substrate, extending in a first direction thereon;

forming a first dielectric layer, of a first glass material containing ZnO and substantially no lead, on the major surface of the substrate so as to cover the display electrodes;

defining a first portion of the first dielectric layer covering first portions of the display electrodes corresponding to the discharge space and a second portion of the dielectric layer covering second portions of the display electrodes, the second portions of the display electrodes being integral with and comprising terminal portions of respective first portions of the display electrodes;

assembling a second substrate, having a major surface, with the first substrate by positioning the respective major surfaces of the first and second substrates in opposed relationship and with the discharge space therebetween, a periphery of the second substrate defining a periphery of the discharge space and the second portions of the display electrodes with the second portion of the first dielectric layer thereon extending in the first direction beyond the periphery and being exposed;

applying a sealant between portions of the opposed surfaces of the first and second substrates along the periphery of the second substrate, bounding the discharge space;

heating the sealant so as to melt the sealant and form a joint along the periphery which bounds and seals the discharge space and fixedly joins the first and second substrates; and after the sealant heating step, removing the exposed portion of the dielectric layer so as to expose the second portions of the display electrodes.

12. The method of fabricating a plasma display panel as recited in claim 11, wherein the display electrodes are formed of a transparent electrically conductive film or of a multiple layer film combination of a transparent electrically conductive film of a first width and a metal film of a second, narrower width.

13. The method of fabricating a plasma display panel as recited in claim 11, wherein the first glass material further contains alkaline metal oxide.

14. The method of fabricating a plasma display panel as recited in claim 11, wherein the first material further contains bismuth oxide.

15. The method of fabricating a plasma display panel as recited in claim 11, wherein the first glass material further contains sodium oxide.

16. The method of fabricating a plasma display panel as recited in claim 11, further comprising forming the second dielectric layer of a PbO-containing glass material.

17. The method of fabricating a plasma display panel as recited in claim 11, further comprising using, as the first substrate, a soda-lime glass plate coated with silicon dioxide on the major surface thereof on which display electrodes are formed.

18. The method of fabricating a plasma display panel as recited in claim 11, further comprising forming the display electrodes in sequential steps of:

forming a plurality of transparent conductive films on the major surface of the first substrate; and forming respective, plural metal bus electrodes on the respective, transparent conductive films.

19. The method of fabricating a plasma display panel as recited in claim 18, further comprising forming the metal bus electrodes by vapor deposition or sputtering and patterning.

20. The method of fabricating a plasma display panel as recited in claim 11, further comprising forming the dielectric layer by screen printing.

21. The method of fabricating a plasma display panel as recited in claim 11, further comprising prior to the assembling step:

forming a second dielectric layer, of a second glass material having a second melting temperature lower than a first softening temperature of the first glass material, on the first portion of the first dielectric layer; and heating the second dielectric layer at a temperature lower than the softening temperature of the first dielectric layer so as to cause the material of the second dielectric layer to flow and form a flat exposed surface facing the discharge space.

22. A method of fabricating a substrate of an AC type plasma display panel having a discharge space and wherein the substrate has a major surface on which electrically conductive display electrodes are formed, the method comprising:

forming a first dielectric layer, of a first glass material containing ZnO and substantially no lead, on the major surface of the substrate so as to cover the display electrodes, defining a first portion of the first dielectric layer covering first portions of the display electrodes corresponding to the discharge space and a second portion of the first dielectric layer covering second portions of the display electrodes, the second portions of the display electrodes being integral with and comprising terminal portions of respective first portions of the display electrode;

forming a second dielectric layer, of a second glass material having a second softening temperature lower than a first softening temperature of the first dielectric layer, on the first portion of the first dielectric layer;

heating the second dielectric layer at a temperature lower than the first softening temperature of the first dielectric layer so as to cause the material of the second dielectric layer to flow and form a flat exposed surface; and removing the second portion of the first dielectric layer to expose the second portions of the display electrodes.

23. The method of fabricating a substrate of an AC type plasma display panel as recited in claim 22, wherein the first glass material further contains an alkaline metal oxide.

24. The method of fabricating a substrate of an AC type plasma display panel as recited in claim 22, wherein the first glass material further contains bismuth oxide.

25. The method of fabricating a substrate of an AC type plasma display panel as recited in claim 22, wherein the first glass material further contains sodium oxide.

26. A method of fabricating a plasma display panel having a discharge space, comprising the steps of:

forming a plurality of electrically conductive display electrodes on a major surface of a first substrate, extending in a first direction thereon;

forming a first dielectric layer, of a first glass material containing ZnO and substantially no lead, on the major surface of the substrate so as to cover the display electrodes;

defining a first portion of the first dielectric layer covering first portions of the display electrodes corresponding to the discharge space and a second portion of the dielectric layer covering second portions of the display electrodes, the second portions of the display electrodes being integral with and comprising terminal portions of respective first portions of the display electrodes;

forming a second dielectric layer, of a second glass material having a second melting temperature lower than a first softening temperature of the first glass material, on the first portion of the first dielectric layer;

heating the second dielectric layer at a temperature lower than the softening temperature of the first dielectric layer so as to cause the material of the second dielectric layer to flow and form a flat exposed surface facing the discharge space;

assembling a second substrate, having a major surface, with the first substrate by positioning the respective major surfaces of the first and second substrates in opposed relationship and with the discharge space therebetween, a periphery of the second substrate defining a periphery of the discharge space and the second portions of the display electrodes with the second portion of the first dielectric layer thereon extending in the first direction beyond the periphery and being exposed;

applying a sealant between portions of the opposed surfaces of the first and second substrates along the periphery of the second substrate, bounding the discharge space;

heating the sealant so as to melt the sealant and form a joint along the periphery which bounds and seals the discharge space and fixedly joins the first and second substrates; and after the sealant heating step, removing the exposed portion of the dielectric layer so as to expose the second portions of the display electrodes.

27. The method of fabricating a plasma display panel as recited in claim 26, wherein the display electrodes are formed of a transparent electrically conductive film or of a multiple layer film combination of a transparent electrically conductive film of a first width and a metal film of a second, narrower width.

28. The method of fabricating a plasma display panel as recited in claim 26, wherein the first glass material further contains alkaline metal oxide.

29. The method of fabricating a plasma display panel as recited in claim 26, wherein the first material further contains bismuth oxide.

30. The method of fabricating a plasma display panel as recited in claim 26, wherein the first glass material further contains sodium oxide.

31. The method of fabricating a plasma display panel as recited in claim 26, further comprising forming the second dielectric layer of a PbO-containing glass material.

32. The method of fabricating a plasma display panel as recited in claim 26, further comprising using, as the first substrate, a soda-lime glass plate coated with silicon dioxide on the major surface thereof on which display electrodes are formed.

33. The method of fabricating a plasma display panel as recited in claim 26, further comprising forming the display electrodes in sequential steps of:

forming a plurality of transparent conductive films on the major surface of the first substrate; and forming respective, plural metal bus electrodes on the respective, transparent conductive films.

34. The method of fabricating a plasma display panel as recited in claim 33, further comprising forming the metal bus electrodes by vapor deposition or sputtering and patterning.

35. The method of fabricating a plasma display panel as recited in claim 26, further comprising forming the dielectric layer by screen printing.

* * * * *

UNITED STATES PATENT AND TRADEMARK OFFICE

CERTIFICATE OF CORRECTION

PATENT NO. : 6,159,066
DATED : December 12, 2000
INVENTOR(S) : Masashi Amatsu et al.

It is certified that error appears in the above-identified patent and that said Letters Patent is hereby corrected as shown below:

Column 11,
Line 4, delete "dielectric";
Line 7 , change "," to -- and firing the first glass material layer; --.

Signed and Sealed this

Twenty-fifth Day of September, 2001

*Attest:*

Nicholas P. Godici

NICHOLAS P. GODICI
*Acting Director of the United States Patent and Trademark Office*

*Attesting Officer*